US006490988B2

(12) United States Patent
Caprioglio

(10) Patent No.: US 6,490,988 B2
(45) Date of Patent: Dec. 10, 2002

(54) ANCHOR ASSEMBLY FOR BOATS AND WATERCRAFTS IN GENERAL

(75) Inventor: Enzo Caprioglio, Milan (IT)

(73) Assignee: Silvana Carla Restelli, Milan (IT)

( * ) Notice: Subject to any disclaimer, the term of this patent is extended or adjusted under 35 U.S.C. 154(b) by 0 days.

(21) Appl. No.: 09/784,269

(22) Filed: Feb. 15, 2001

(65) Prior Publication Data

US 2002/0162497 A1 Nov. 7, 2002

(30) Foreign Application Priority Data

Feb. 18, 2000 (IT) ..... MI00A0303

(51) Int. Cl.[7] ..... B63B 21/24

(52) U.S. Cl. ..... 114/293; 114/294

(58) Field of Search ..... 114/230.1, 230.12, 114/230.2, 230.23, 230.26, 230.28, 230.29, 293, 294, 297, 300, 126, 127, 140; 441/21, 23, 28; D12/215

(56) References Cited

U.S. PATENT DOCUMENTS

| | | | | | |
|---|---|---|---|---|---|
| 1,065,400 | A | * | 6/1913 | Spaulding | 114/349 |
| 2,599,200 | A | * | 6/1952 | Rogers | 114/179 |
| 3,083,675 | A | * | 4/1963 | Rice | 114/300 |
| 3,559,607 | A | * | 2/1971 | Macander et al. | 114/51 |
| 3,577,951 | A | * | 5/1971 | Smith | 114/210 |
| 3,774,562 | A | * | 11/1973 | Dean, III | 114/293 |
| 3,837,590 | A | * | 9/1974 | Pollak | 242/407 |
| 3,858,877 | A | * | 1/1975 | Lundstrom | 473/14 |
| 4,090,463 | A | * | 5/1978 | Soderberg | 114/294 |
| 4,651,139 | A | * | 3/1987 | Oettli | 340/531 |
| 5,081,947 | A | * | 1/1992 | Holden | 114/345 |
| 5,579,712 | A | * | 12/1996 | Rinker et al. | 114/297 |
| 5,934,219 | A | * | 8/1999 | Poiraud | 114/294 |

* cited by examiner

*Primary Examiner*—S. Joseph Morano
*Assistant Examiner*—Andrew Wright
(74) *Attorney, Agent, or Firm*—Hedman & Costigan, P.C.

(57) ABSTRACT

An anchor assembly for a watercraft comprises a spherical stainless steel-lead filled heavy body to be removably coupled to the hull of the watercraft by a stainless steel coupling cable, the heavy body being so designed as to provide a "dead body" with the watercraft in an anchored condition.

3 Claims, 4 Drawing Sheets

ANCHOR ASSEMBLY FOR BOATS AND WATERCRAFTS IN GENERAL

SUMMARY OF THE INVENTION

An anchor assembly for watercrafts in general, characterized in that said anchor assembly comprises a heavy body, which is removably coupled to a vessel of a said watercraft and connected to a coupling cable, and that said heavy body, as said watercraft has been anchored, provides a "dead body".

BACKGROUND OF THE INVENTION

The present invention relates to an anchor assembly for boats and watercrafts in general.

As is known, a very important problem for anchoring boats and watercrafts in general, and, in particular sail boats and high tonnage vessels, is that of providing an anchor assembly or apparatus effective to provide a firm and safe anchoring.

Conventional anchor means provide to use an anchor element, fixed to an anchor chain.

If the anchor element, which has a comparatively small weight, is thrown on a sand bottom, it will have poor anchoring properties, and would be subjected to undesired movements because of the sea waves and streams.

Moreover, on rock bottoms, prior anchor elements can undesirable easily jam, thereby they could be recovered only by difficult and dangerous recovering operations.

Another problem is that prior anchor elements are conventionally coupled to a galvanized iron chain, which must be necessarily washed by sweet water, in order to prevent any corrosion problems, with a consequent waste of sweet water.

Moreover, the links of the chain, in particular those arranged at the mooring and nose portions of said chains, are subjected to a comparatively quick wear, which cannot be always easily detected, thereby the anchor chain can be easily broken with a consequent loose of the watercraft.

Yet another drawback is that conventional anchor-chain anchoring devices involve a displacement of the watercraft from the bottom anchoring point, with a possible danger that other chains or cables or bodies could overlap on an anchoring chain at an anchoring place, with consequent undesired jammings.

SUMMARY OF THE INVENTION

Accordingly, the aim of the present invention is to overcome the above mentioned drawbacks, by providing an anchor assembly for boats in general, adapted to modify the conventional anchoring technique, and including an anchoring element specifically designed to provide a firm anchoring to the bottom of the sea, thereby allowing to use a length of the anchoring chain much smaller than that which would be necessary in conventional anchoring apparatus.

Within the scope of the above mentioned aim, a main object of the present invention is to provide such an anchor body which is not subjected to slip movements the conventional anchors are subjected to.

In fact, the latter, because of their small weight, have anchoring properties which are negatively affected by the natural characteristics of the sea and the like bottoms.

Yet another object of the present invention is to provide such an anchor assembly which is not subjected to jammings, even in the presence of a water bottom including a lot of differently contoured rocks.

Yet another object of the present invention is to provide such an anchor assembly which can be easily recovered without any dangers of tangling with other anchoring chains or elements which could be present on the water bottom.

According to one aspect of the present invention, the above mentioned aim and objects, as well as yet other objects, which will become more apparent hereinafter, are achieved by an anchor assembly for watercrafts in general, characterized in that said anchor assembly comprises a heavy body, to be removably coupled to the shell of a watercraft, and connected to a coupling cable, and that said heavy body is adapted to provide, as it is anchored to said watercraft, a "dead body".

BRIEF DESCRIPTION OF THE DRAWINGS

Further characteristics and advantages of the present invention will become more apparent hereinafter from the following detailed disclosure of a preferred, though not exclusive, embodiment of an anchor assembly for watercrafts in general, which is illustrated, by way of an indicative, but not limitative, example, in the accompanying drawings, where.

DESCRIPTION OF THE PREFERRED EMBODIMENTS

Figure 4:
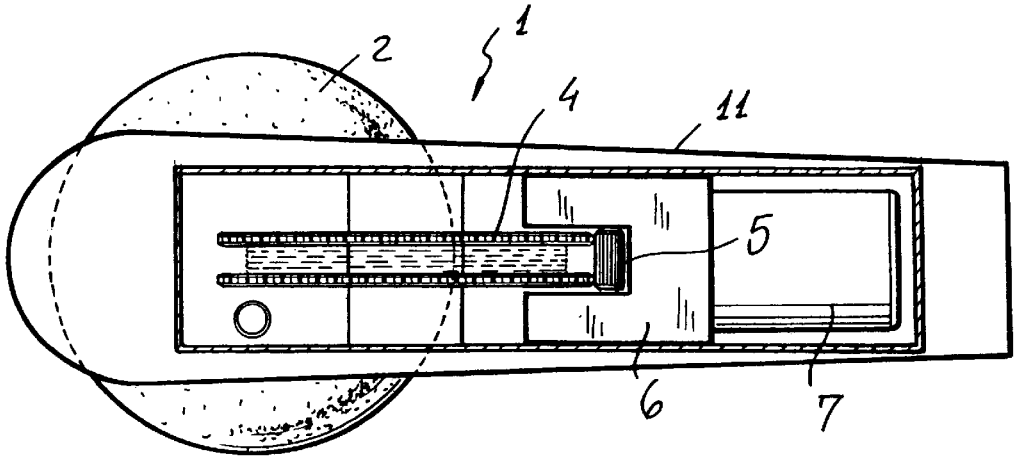
FIG. 4 is a schematic sectional view, substantially taken through a substantially horizontal plane, illustrating the anchor assembly according to the invention.
Figure 1:
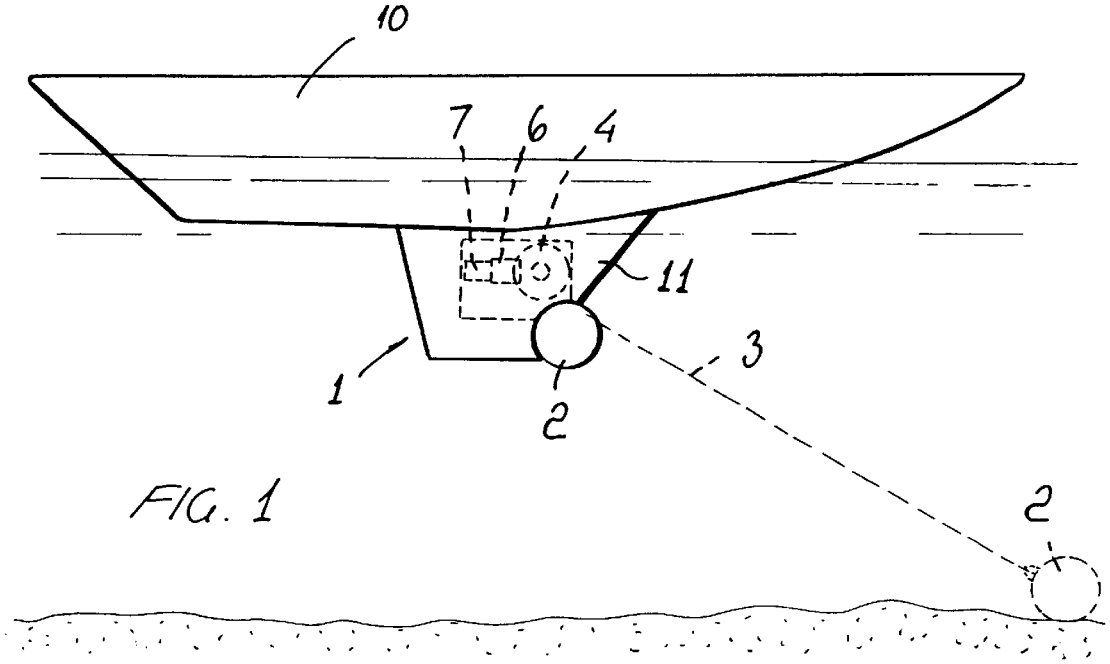
FIG. 1 is a side view illustrating a watercraft to which an anchor assembly according to the present invention has been applied.
Figure 2:
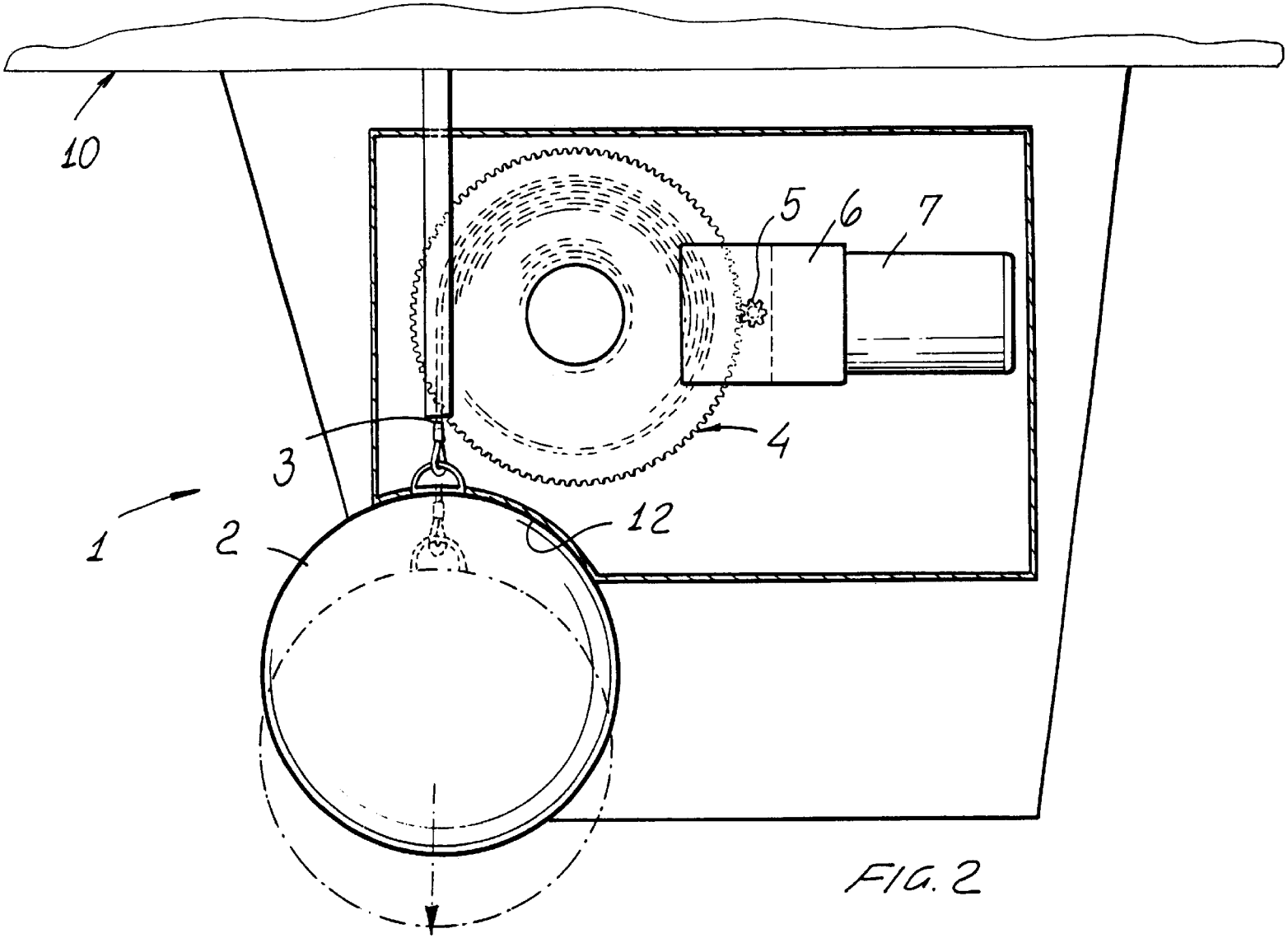
FIG. 2 illustrates, on an enlarged scale, a detail of the anchor assembly, as cross-sectioned along a substantially vertical and longitudinal plane, with respect to the keel of the watercraft.
Figure 3:
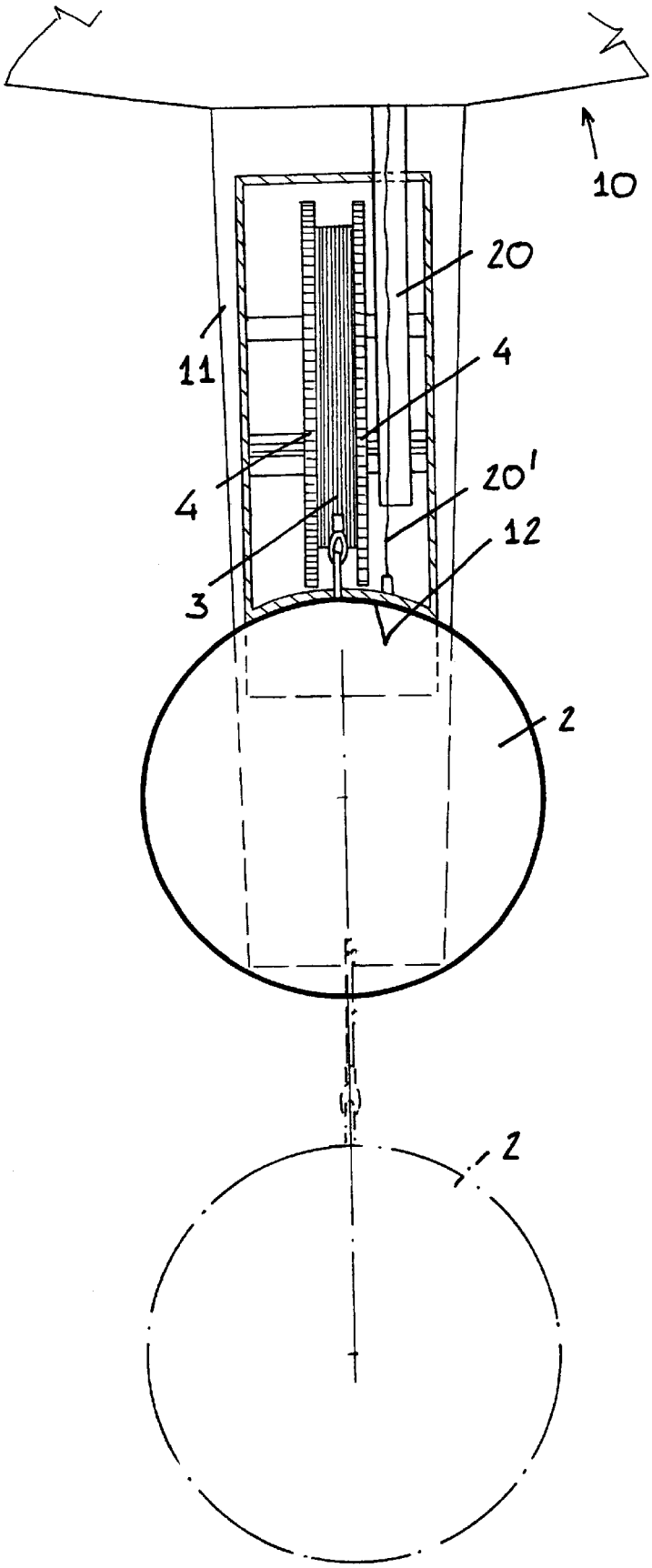
FIG. 3 is a cross-sectional view illustrating the anchor assembly according to the invention.

With reference to the number references of the above mentioned figures, the anchor assembly according to the invention, which has been generally indicated by the reference number 1, comprises a hollow spherical heavy body 2, which is advantageously made of a stainless steel material and is filled by lead, and the weight of which is proportional to the watercraft displacement.

The heavy body 2 is coupled to a stainless steel cable 3, having a suitable strength, wound on a toothed pulley 4, meshing with a pinion 5 included in a motor-reducing unit 6 connected to a driving motor 7.

Said motor-reducing unit is provided with a locking device, adapted to hold a set position.

As shown, the heavy body is removably coupled to the watercraft hull 10, and can be arranged at several different positions, depending on the type of watercraft itself.

If the watercraft is a sail boat, then the heavy body 2 can be installed in a seat 12 formed in the boat centerboard 11.

Such a location would be a preferred one, since a separation of the weights between the bow and the rearmost region, to provide a centrally located boat center of gravity, would cause an increase of the boat pitching during the sailing.

As, on the contrary, the connection point of the heavy body would be arranged at a place arranged at the center of the watercraft, then, in a mooring condition of the boat, the latter would be greatly offset sidewise under the wind stress.

If desired, it would be also possible to connect to the mentioned heavy body 2, in addition to the steel cable 3, designed for preventing the watercraft from displacing, a textile material floating rope 20, providing a comparatively small holding capability, to be arranged in a suitable tube element 20.

This textile material rope would be extended to the terminal end portion of the watercraft bow where it will be collected on a winding device.

In operation, with the watercraft brought to the anchor place, the heavy body 2 will be lowered to the water bottom, and the watercraft will be rearward displaced for a distance substantially corresponding to three times the water depth.

Then, the steel cable will be recovered by the raising mechanism, to bring the watercraft bow at a position slightly withdrawn from the mentioned heavy body.

The excess rope will then float and, after recovering, it will be fixed to a bow bollard.

In this connection it should be apparent that the textile material rope must not hinder the displacement of the watercraft, as pushed by the wind or water streams, since such an effort would be exclusively born by the steel cable.

In particular, said textile material rope 20' will exclusively operate to properly hold the watercraft bow aligned with the heavy body.

The laying and recovery mechanism for laying and recovering the cable 3 can be directly installed in the watercraft centerboard, as above disclosed.

On the other hand, said laying and recovering mechanism could also be arranged inside the boat, at any desired place, in a single block or with the components thereof separated and differently assembled, and this preferably above the floating line.

The heavy body 2 is advantageously made with a spheric configuration, but it could have any desired configuration, such as a pear configuration, a torpedo or bearing wing configuration.

The spheric configuration, however, has the advantage of preventing the heavy body 2 from jamming against objects present on the sea bottom.

According to a preferred embodiment, the mentioned heavy body can have a diameter of about 65 cm and a weight of 1,600 kg, thereby providing a mass constituting a "dead body", adapted to prevent any watercrafts of 16/18 m from being displaced.

With the above disclosed approach, all of the recovering operations for recovering the heavy body will be easily simplified, since on the steel cable coupled to the heavy body no further chains of further boats can overlap, since the subject steel cable has a length which is slightly greater than the water bottom depth.

In this connection it should be pointed out, moreover, that in addition to the heavy body system, a conventional anchor element could also be installed, if necessary, without any danger that the steel cable and chain wind on one another, under weak winds of a variable direction, as the boat is further manoeuvred.

Under a strong opposite wind condition, moreover, the raising of the heavy body will be much simpler than a recovery of a conventional anchor, due to the short length of the steel cable and the comparatively high power of the raising mechanism.

Moreover, the steel cable, as it is wound on a pulley, does not generate any slipping problems and, moreover, since it is made of a stainless steel material, it does not require to be washed by sweet water.

Furthermore, said steel cable would not be subjected to a wear typically affecting the links of a chain and which, as mentioned, would generate a series of problems.

Moreover, by using the steel body in high tonnage vessels, a further safety element is provided, adapted to safely prevent any drift of the vessel, with consequent very great damages, in particular if the vessel payload comprises polluting substances.

The heavy body according to the invention also allows to anchor a vessel or boat even on water bottoms of comparatively great depth, thereby allowing the vessels to be held away from the coast, since the steel cable, being wound on a pulley, will have a very reduced volume.

Thus, it would be possible to store a comparatively great portion of said cable.

Figure 6:
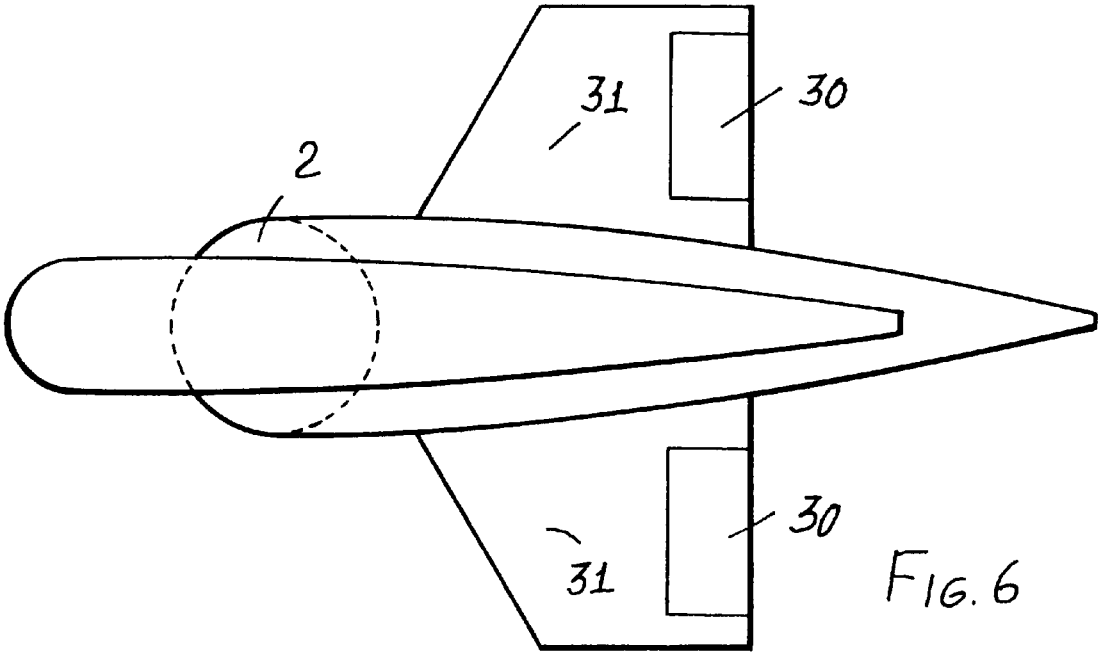
FIG. 6 is a top plan view of the anchor assembly according to the invention.
Figure 5:
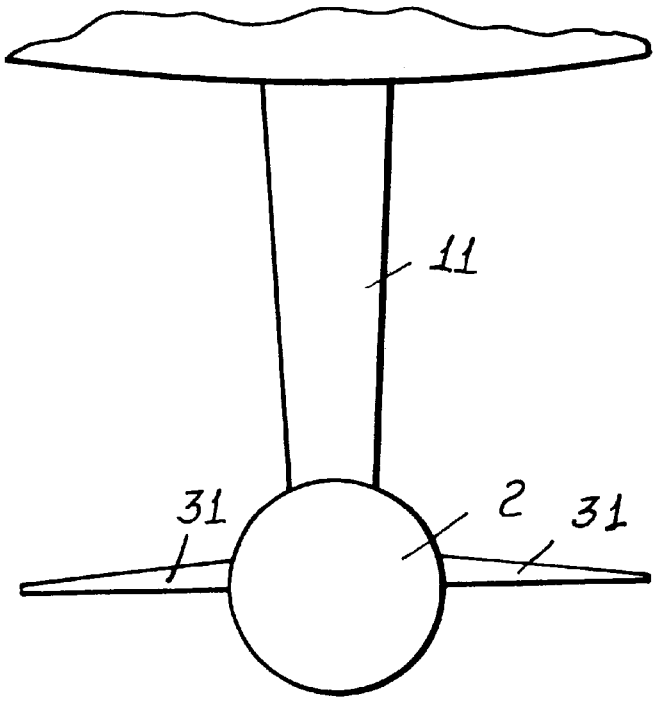
FIG. 5 is a detailed side view of the anchor assembly according to the present invention arranged under the underbody of a watercraft and coupled to a bulbous element, provided with stabilizing wings.

With reference to FIGS. 5 and 6 of the accompanying drawings, a heavy body 2 is herein shown which is applied to the bulbous portion of a centerboard 11, having stabilizing wings 31 providing the watercraft with very hydrodynamically efficient features 30.

In this connection it should be moreover pointed out that the stainless steel cable, coupled to said heavy body, could also be replaced by a conventional chain or a nylon cable, having any desired suitable size.

In the case shown in FIGS. 5 and 6, stabilizing supporting wings 31 are shown which, however, would be optional and, if desired, could be also provided with further stabilizing elements.

The latter, as driven by an electronically controlled hydraulic system, would be designed for reducing the inclination of the watercraft, under a side wind, while increasing an exposed sail surface, with a consequent advantage from the watercraft rate standpoint.

From the above disclosure it should be apparent that the invention fully achieves the intended aim and objects.

In particular, the fact is to be pointed out that an anchor assembly has been provided which, by drastically modifying conventional anchoring techniques, provides a very efficient and operationally functional system.

The invention as disclosed is susceptible to several modifications and variations, all of which will come within the scope of the invention.

Moreover, all the constructional details can be replaced by other technically equivalent elements.

In practicing the invention, the used materials, provided that they are compatible to the intended application, as well as the contingent size and shapes, can be any, according to requirements.

What is claimed is:

1. Anchor assembly for a watercraft, comprising a stainless steel coupling cable, having one end coupled to a cable raising mechanism supported by said watercraft and including a toothed pulley driven by a pinion connected to a motor-reducing unit comprising a locking device and another end coupled to a heavy body, said heavy body being a stainless steel spherical heavy body filled with lead.

2. An anchor assembly, according to claim 1, wherein said spherical heavy body has a diameter of substantially 65 cm and a weight of substantially 1600 kg.

3. An anchor assembly, according to claim 1, wherein said anchor assembly further comprises a floating textile material rope coupled to said spherical heavy body, said rope being housed in an housing tube, and being extended to a bow end portion of said watercraft.

* * * * *